US009347421B2

(12) United States Patent
Woerner et al.

(10) Patent No.: US 9,347,421 B2
(45) Date of Patent: May 24, 2016

(54) LASER IGNITION DEVICE FOR AN INTERNAL COMBUSTION ENGINE

(75) Inventors: Pascal Woerner, Korntal-Muenchingen (DE); Juergen Raimann, Weil der Stadt (DE); Joerg Engelhardt, Ditzingen (DE); Martin Weinrotter, Vitoria-Gasteiz (ES)

(73) Assignee: ROBERT BOSCH GMBH, Stuttgart (DE)

( * ) Notice: Subject to any disclaimer, the term of this patent is extended or adjusted under 35 U.S.C. 154(b) by 330 days.

(21) Appl. No.: 13/996,979

(22) PCT Filed: Oct. 27, 2011

(86) PCT No.: PCT/EP2011/068906

§ 371 (c)(1),
(2), (4) Date: Sep. 10, 2013

(87) PCT Pub. No.: WO2012/084311

PCT Pub. Date: Jun. 28, 2012

(65) Prior Publication Data

US 2013/0340696 A1 Dec. 26, 2013

(30) Foreign Application Priority Data

Dec. 23, 2010 (DE) ..... 10 2010 064 023

(51) Int. Cl.
*F02P 23/04* (2006.01)

(52) U.S. Cl.
CPC ..... *F02P 23/04* (2013.01)

(58) Field of Classification Search
CPC ..... F02P 23/04
USPC ..... 123/143 B; 701/102
See application file for complete search history.

(56) References Cited

U.S. PATENT DOCUMENTS

| | | | | |
|---|---|---|---|---|
| 4,824,495 | A * | 4/1989 | Verneker | C06B 33/02 102/293 |
| 8,783,221 | B2 * | 7/2014 | Woerner | F02P 23/04 123/143 B |
| 2008/0022992 | A1 * | 1/2008 | Wahl | B08B 17/06 126/200 |
| 2011/0259292 | A1 * | 10/2011 | Woerner | F02P 23/04 123/143 B |
| 2012/0132167 | A1 * | 5/2012 | Weinrotter | H01S 3/042 123/143 B |
| 2013/0340696 | A1 * | 12/2013 | Woerner | F02P 23/04 123/143 B |

FOREIGN PATENT DOCUMENTS

| | | | | |
|---|---|---|---|---|
| DE | WO 2005066488 | A1 * | 7/2005 | F02P 23/04 |
| JP | H 09-250438 | | 9/1997 | |
| JP | 2010 116841 | | 5/2010 | |
| RU | 2 362 042 | | 7/2009 | |
| WO | WO 2005/066488 | | 7/2005 | |
| WO | WO 2005066488 | A1 * | 7/2005 | F02P 23/04 |
| WO | WO 2010/057904 | | 5/2010 | |

OTHER PUBLICATIONS

International Search Report, PCT International Application No. PCT/EP2011/068906, dated Feb. 28, 2012.

* cited by examiner

*Primary Examiner* — Stephen K Cronin
*Assistant Examiner* — Joshua A Campbell
(74) *Attorney, Agent, or Firm* — Norton Rose Fulbright US LLP

(57) ABSTRACT

A laser ignition device for an internal combustion engine, encompassing an ignition laser having a combustion chamber window, such that until startup of the laser ignition device, the combustion chamber window is equipped with a protective layer.

15 Claims, 3 Drawing Sheets

LASER IGNITION DEVICE FOR AN INTERNAL COMBUSTION ENGINE

FIELD

The present invention relates to a laser ignition device for an internal combustion engine, encompassing an ignition laser having a combustion chamber window as well as a protective layer, and a method for startup according to coordinated claims.

BACKGROUND INFORMATION

A laser ignition device is described, for example, in PCT Application No. WO 2005/0066488 A1.

An ignition laser has a combustion chamber window that is transparent to the laser pulses emitted from the ignition laser. An aperture stop is described in PCT Application No. WO 2010/057904 in order to protect the combustion chamber window from contaminants or damage during operation of the internal combustion engine. The combustion chamber window is not protected, however, during the time period between functional testing during manufacture and initial startup of the internal combustion engine, or during extended stoppage phases prior to startup of the internal combustion engine. In the context of installation of the new part, the combustion chamber window can become soiled as a result of an unclean working environment in the shop, contaminants in the spark plug hole, condensation during the cold engine starting operation, or sprayed oil from the internal combustion engine. After extended stoppage phases, particle accumulation or condensation in particular can negatively affect the service life of the combustion chamber window or even result in malfunction of the laser ignition device.

SUMMARY

Main features of the present invention are described below and shown in the figures; the features can be used both in isolation and in different combinations, although no further explicit reference is made thereto.

In accordance with the present invention, the combustion chamber window of an ignition laser is effectively protected, until initial operation, from soiling that can negatively influence the service life of the combustion chamber window or even result in a malfunction of the laser ignition system. The combustion chamber window can moreover, as a result of application of a protective layer in accordance with to the present invention prior to extended stoppage phases of the internal combustion engine, be protected from condensation or sprayed oil until it is started up again.

In accordance with the present invention, upon startup of the laser ignition device, the protective layer is combusted by the laser pulses or at least destroyed thereby to the extent that the laser pulses can travel without impediment into the combustion chamber of the internal combustion engine. As long as the protective layer is intact, contaminants become deposited onto the protective layer. With the first laser pulses, i.e., upon initial startup of the internal combustion engine, the protective layer is combusted and the beam path is opened up. Any residues of the protective layer still adhering to the combustion chamber window are destroyed by the hot combustion gases in the combustion chamber during operation of the internal combustion engine and are removed from the combustion chamber together with the exhaust gas.

In accordance with the present invention, a protective layer that absorbs the laser pulse may be used. As a result, the protective layer becomes greatly heated by the energy transported by the laser pulse and already thermally combusts with the first laser pulses. Subsequent further laser pulses then ignite the fuel-air mixture in the combustion chamber without energy losses.

In accordance with the present invention, the protective layer may be transparent to the laser pulse. With this example embodiment according to the present invention, the protective layer is combusted not by the laser pulse but only by the onset of combustion of fuel upon operation of the internal combustion engine. This ensures that upon an initial startup, the ignition laser ignites the fuel in the combustion chamber with little energy loss, and the protective layer then burns off without residue together with the fuel.

It is further favorable if the protective layer is made of an absorbent material. Liquid, oily, or pasty contaminants are absorbed by the absorbent material and are combusted together with the protective layer, for example cellophane paper.

A further embodiment provides that the protective layer is made of dirt-repelling material (for example as a result of the so-called lotus effect). If a protective layer, for example a plastic film, on whose surface liquid contaminants bead up is used, only very small quantities of the substances become deposited thereonto, and the laser pulse can burn its way through the combustion chamber window upon first operation with little energy loss.

It is particularly helpful if the protective layer is made of an elastic material, and if this protective film is mounted on the ignition laser in radially pre-tensioned fashion. When the ignition laser then burns a hole in the center of the film, the protective film then ruptures because of its own tension. The radial pre-tensioning causes tearing from the inside out, and the contaminants adhering to the protective film, and the protective film itself, are flung away outward. The laser pulses can thus travel without impediment into the combustion chamber.

A solution that is simple in terms of production engineering involves applying the protective layer as a liquid. A liquid can easily be sprayed onto the combustion chamber window, or the combustion chamber window is wetted with the liquid by immersing the ignition laser thereinto. If a liquid of corresponding viscosity is used, it is also possible to embody a protective layer in the aperture stop opening. The surface tension of the liquid results in formation of a membrane, similar to a soap bubble, between the edges of the aperture stop opening. After drying or curing, the liquid then forms a protective layer having the required properties.

The laser ignition system according to the present invention works even better if an aperture stop is disposed between the protective layer and the combustion chamber window. The result is firstly that the protective layer is disposed at a distance from the combustion chamber window so that the latter is protected during the burning-through operation, and secondly that the protective layer is thereby closer to the ignition point. Because the energy density of the laser pulse is greatest at the ignition point, this ensures that the protective layer burns off quickly and completely. The greater the distance from the ignition point, the thinner the protective layer should be.

A further embodiment of the laser ignition system according to the present invention provides that the protective layer is disposed at an ignition point. As already explained above, this ensures reliable burn-off of the protective layer.

A solution that is simple in terms of production engineering is one in which the protective layer is curved. The use of a convexly shaped protective layer makes it possible, in particularly simple fashion, to dispose the protective layer at the ignition point. For this, the protective layer, upon attachment or as a prefabricated component, is bulged out so that a vertex is located at the ignition point of the laser pulse. The advantages set forth above result therefrom.

It is further proposed that the protective layer be integrated into a pre-chamber cap. In pre-chamber ignition lasers, a pre-chamber cap is screwed or welded onto the laser ignition device at the end face facing toward the combustion chamber, forming a kind of pre-chamber in which the fuel-air mixture is ignited. The ignition point is thus located inside the pre-chamber cap, and what emerges as a relatively simple solution is to integrate the protective layer into the pre-chamber cap and thus dispose it directly at the ignition point. Because the energy density of the laser pulse is greatest at the ignition point, the protective layer according to the present invention reliably burns off at startup.

A method for starting up a laser ignition device of the kind characterized above is also proposed. The same advantages as above apply.

Further features, potential applications, and advantages of the present invention are evident from the description below of exemplifying embodiments of the present invention that are depicted in the Figures. All features described or depicted, individually or in any combination, constitute the subject matter of the present invention, irrespective of their presentation and depiction below in the figures, respectively.

DETAILED DESCRIPTION OF EXAMPLE EMBODIMENTS

Figure 1:
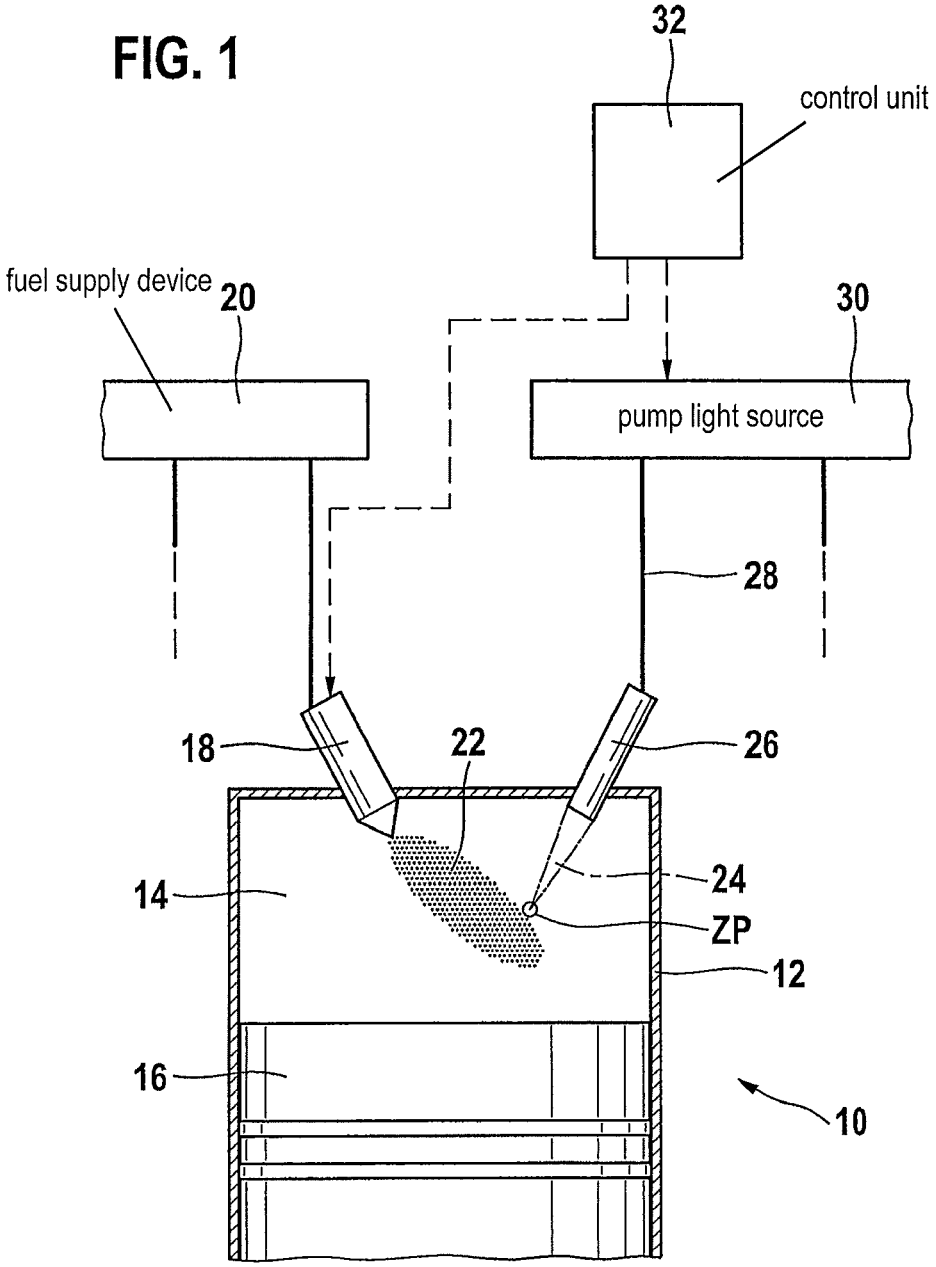
FIG. 1 schematically depicts an internal combustion engine having a laser ignition device.

The same reference characters are used in all Figures for functionally equivalent elements and variables, including in a context of different embodiments.

An internal combustion engine bears the reference character 10 in FIG. 1. Internal combustion engine 10 encompasses multiple cylinders, of which only one, having the reference character 12, is depicted in the Figure. A combustion chamber 14 of cylinder 12 is demarcated by a piston 16. Fuel travels into combustion chamber 14 directly through an injector 18 that is connected to a fuel supply device 20, or is premixed with air in an intake duct (not depicted). Fuel-air mixture 22 is ignited in combustion chamber 14 at an ignition point ZP by a laser pulse 24. Laser pulse 24 is emitted from an ignition laser 26 into combustion chamber 14. For this, ignition laser 26 is supplied via a light guide device 28 from a pump light source 30. A control unit 32 controls, inter alia, pump light source 30 and injector 18.

Figure 2:
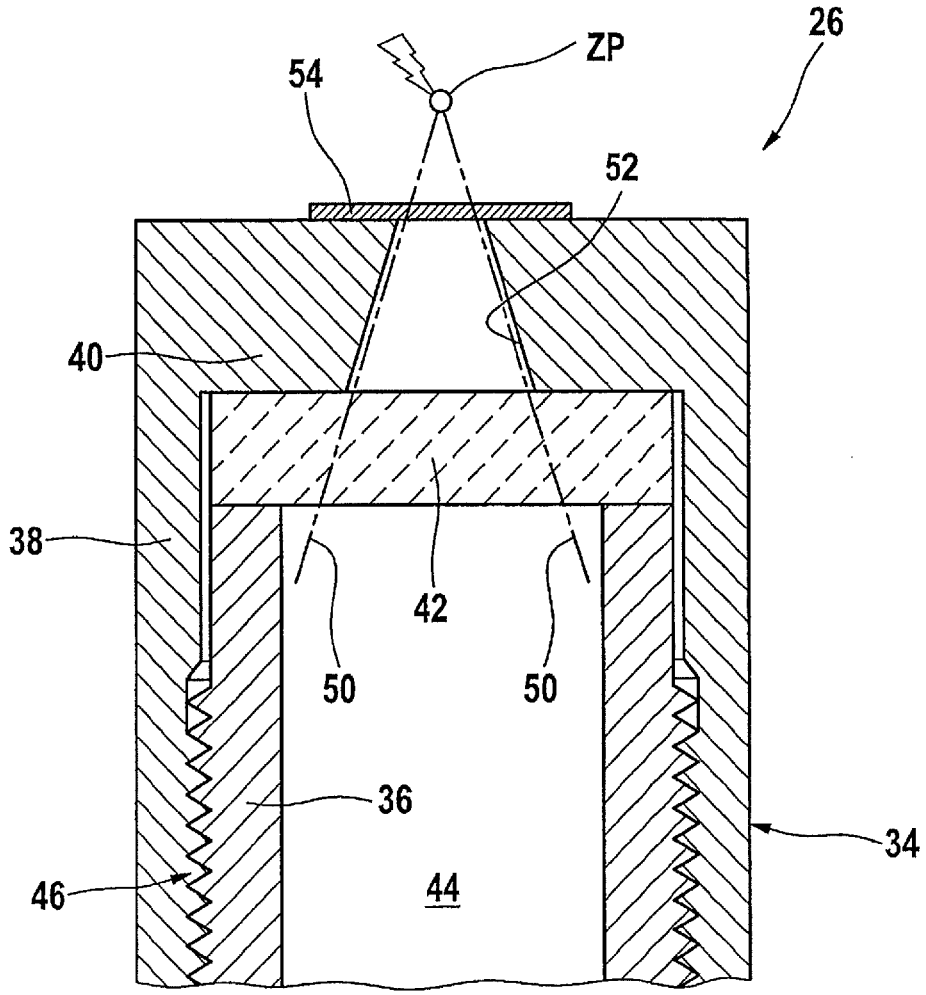
FIG. 2 shows a first example embodiment of the ignition laser according to the present invention having a protective layer.

FIG. 2 is a schematic longitudinal section through that end of ignition laser 26 which faces toward combustion chamber 14. In the exemplifying embodiment depicted, a housing 34 of ignition laser 26 is embodied in two parts. It encompasses an inner sleeve 36 and an outer sleeve 38. Outer sleeve 38 has a closure 40 at its end facing toward combustion chamber 14. Closure 40 serves to press a combustion chamber window 42 against inner sleeve 36 and thereby to seal an interior 44 of inner sleeve 36, and the components (not depicted) of ignition laser 26 disposed therein, such as a deflection or focusing optic or a laser-active solid, with respect to combustion chamber 14. Outer sleeve 38 is equipped for this purpose with an internal thread that coacts with a corresponding external thread on inner sleeve 36. The threaded connection made up of the internal thread and external thread is labeled in its entirety with the reference character 46.

The focusing optic (not depicted) focuses laser pulse 24 onto an ignition point ZP. The contour of the focused laser pulse 24 is indicated by conical dot-dash enveloping lines 50. These enveloping lines 50 emerge from combustion chamber window 42 and intersect at ignition point ZP. Outer sleeve 38 has an aperture stop 52 at the end so that that side of combustion chamber window 42 which faces toward combustion chamber 14 is protected. This aperture stop can be conical or cylindrical. A conical angle or a diameter of aperture stop 52 is selected so that it approximately corresponds respectively to a conical angle or diameter of laser pulse 24.

Provision is now made according to the present invention that a protective layer 54 or membrane is mounted on the end face of outer sleeve 38 so that it closes off aperture stop 52 until an initial startup of ignition laser 26 and thereby protects combustion chamber window 42, located behind it, from deposits and soiling. Protective layer 54 can be made of paper, plastic, metal, or rubber. Also possible is application of an oily or pasty liquid that forms a protective layer directly on combustion chamber window 42 and is burned off by the first laser pulse 24 or upon combustion of fuel-air mixture 22.

Figure 3:
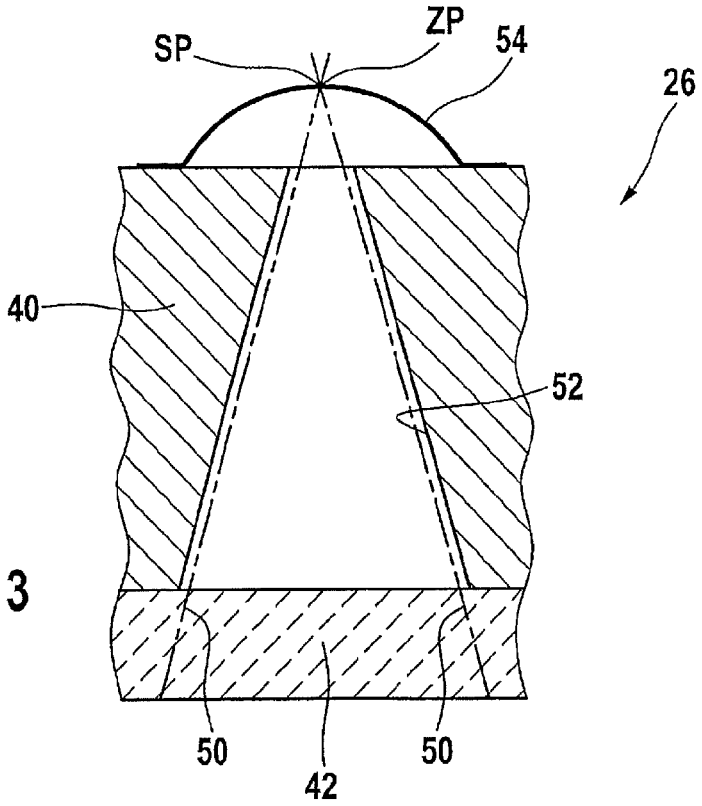
FIG. 3 shows a second example embodiment of the ignition laser according to the present invention.

FIG. 3 is a longitudinal section through a detail of that end of the laser ignition device according to the present invention which faces toward combustion chamber 14. The detail shows combustion chamber window 42 with closure 40 of outer sleeve 38 disposed in front of it. Aperture stop 52 is introduced into closure 40. Enveloping lines 50 of laser pulse 24 pass out of outer sleeve 38 through aperture stop 52 and intersect at ignition point ZP. Protective layer 54 according to the present invention has a curvature such that a vertex SP of protective layer 54 is located at ignition point ZP. The curved protective layer 54 can be applied as a prefabricated component, or can be correspondingly shaped only upon application. In both cases an adhesive bonding method is appropriate for fastening, for example using super glue.

Figure 4:
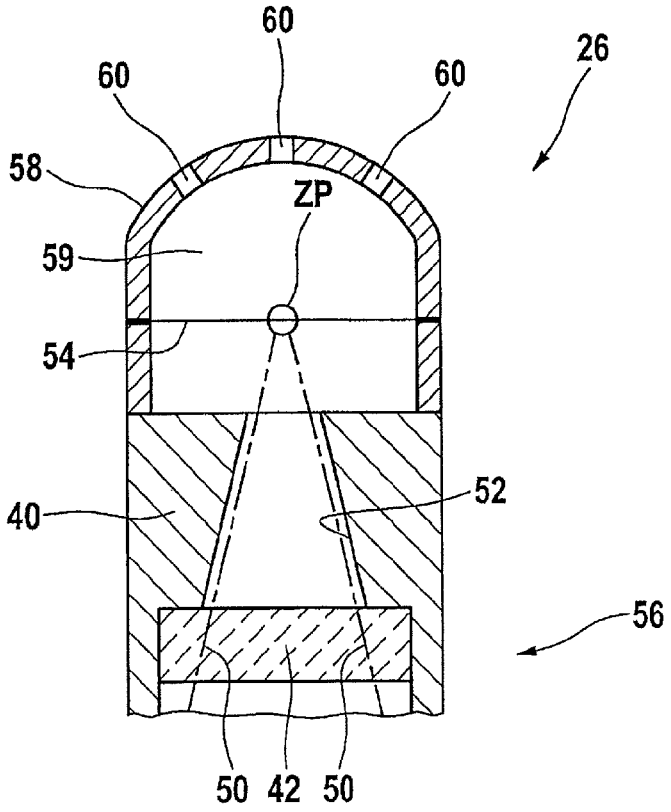
FIG. 4 shows a third example embodiment of the ignition laser according to the present invention.

A further embodiment of the laser ignition device according to the present invention is depicted in FIG. 4. The drawing is a longitudinal section through a pre-chamber ignition laser 56. This, like the embodiments of ignition laser 26 described previously, encompasses a combustion chamber window 42 and a closure 40 in which an aperture stop 52 is disposed, so that laser pulse 24, indicated by its enveloping lines 50, can pass through in a manner focused onto ignition point ZP. Prechamber laser ignition plug 56 furthermore possesses an end cap 58. The latter is disposed so that it encloses, together with that end face of ignition laser 24 which faces toward the combustion chamber, a pre-chamber 59 that encloses ignition point ZP. Cutouts 60 that permit a gas exchange between prechamber 59 and combustion chamber 14 are disposed in end cap 58. Protective layer 54 is disposed in end cap 58 in such a way that it forms, between closure 40 and cutouts 60, a plane on which ignition point ZP is located.

What is claimed is:

1. A laser ignition device for an internal combustion engine, comprising:

an ignition laser having a combustion chamber window, wherein until startup of the laser ignition device, the combustion chamber window is equipped with a protective layer, wherein the protective layer combusts upon startup of the laser ignition device.

2. The laser ignition device as recited in claim 1, wherein the protective layer absorbs a laser pulse.

3. The laser ignition device as recited in claim 1, wherein the protective layer is transparent to a laser pulse.

4. The laser ignition device as recited in claim 1, wherein the protective layer is made of an absorbent material.

5. The laser ignition device as recited in claim 1, wherein the protective layer is made of a dirt-repelling material.

6. The laser ignition device as recited in claim 1, wherein the protective layer is made of an elastic material.

7. The laser ignition device as recited in claim 1, wherein the protective layer is applied as a liquid.

8. The laser ignition device as recited in claim 1, wherein an aperture stop is disposed between the protective layer and the combustion chamber window.

9. The laser ignition device as recited in claim 1, wherein the protective layer is disposed at an ignition point.

10. The laser ignition device as recited in claim 1, wherein the protective layer is curved.

11. The laser ignition device as recited in claim 1, wherein the protective layer is integrated into an end cap.

12. A protective layer for covering a combustion chamber window of a laser ignition device, comprising at least one of a metal foil, plastic film, paper, cellophane paper, oil, and a paste.

13. The protective layer as recited in claim 12, wherein the protective layer is transparent or opaque to laser light.

14. A method for starting up a laser ignition device for an internal combustion engine having a combustion chamber window that is equipped with a protective layer, the method comprising:

burning a hole into the protective layer by laser pulses of the laser ignition device in an absence of an ignitable fuel-air mixture.

15. The method as recited in claim 14, wherein the protective layer is completely burned off upon operation of the internal combustion engine.

* * * * *